US010122134B2

(12) United States Patent
Shibuya

(10) Patent No.: US 10,122,134 B2
(45) Date of Patent: Nov. 6, 2018

(54) ELECTRICAL CONNECTOR

(71) Applicant: Hirose Electric Co., Ltd., Tokyo (JP)

(72) Inventor: Kazunari Shibuya, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/649,916

(22) Filed: Jul. 14, 2017

(65) Prior Publication Data

US 2018/0019555 A1 Jan. 18, 2018

(30) Foreign Application Priority Data

Jul. 14, 2016 (JP) ..... 2016-139324

(51) Int. Cl.

| | |
|---|---|
| ***H01R 24/00*** | (2011.01) |
| ***H01R 24/60*** | (2011.01) |
| ***H01R 13/20*** | (2006.01) |
| ***H01R 13/26*** | (2006.01) |
| ***H01R 13/28*** | (2006.01) |
| ***H01R 24/84*** | (2011.01) |
| *H01R 107/00* | (2006.01) |

(52) U.S. Cl.

CPC ..... *H01R 24/60* (2013.01); *H01R 13/20* (2013.01); *H01R 13/26* (2013.01); *H01R 13/28* (2013.01); *H01R 24/84* (2013.01); *H01R 2107/00* (2013.01)

(58) Field of Classification Search

CPC ..... H01R 13/20; H01R 13/26; H01R 13/28; H01R 24/60; H01R 24/84; H01R 2107/00

USPC ..... 439/676

See application file for complete search history.

(56) References Cited

U.S. PATENT DOCUMENTS 5,035,639 A * 7/1991 Kilpatrick ..... H01R 13/28 439/290
5,618,191 A * 4/1997 Chikano ..... H01R 12/716 439/108
5,915,989 A * 6/1999 Adriaenssens ..... H05K 1/0228 439/404

(Continued)

FOREIGN PATENT DOCUMENTS

JP H05-009822 3/1994
JP 2014-127422 7/2014

*Primary Examiner* — Abdullah Riyami
*Assistant Examiner* — Vladimir Imas
(74) *Attorney, Agent, or Firm* — Procopio, Cory, Hargreaves & Savitch LLP

(57) ABSTRACT

The electrical connector terminals are made of sheet metal and have two arm portions that have their major surfaces opposed to each other and separated from each other in a terminal array direction and extend in a direction of connection to counterpart connector bodies; the two arm portions are coupled to each other at their base portions and can come into contact with the counterpart connector bodies by independently undergoing resilient displacement; the contact portions of the two arm portions contacting the corresponding contact portions of the counterpart connector bodies are respectively formed at the distal end sides, i.e. at the sides opposite the base portions, in the direction of connection; and the contact portions of the two arm portions, along with being located in different positions in the direction of connection, are located in overlapping positions in the terminal array direction when connected to the counterpart connector bodies.

2 Claims, 5 Drawing Sheets

(56) References Cited

U.S. PATENT DOCUMENTS

| | | | | |
|---|---|---|---|---|
| 6,561,850 | B2 * | 5/2003 | Letourneau | H01R 12/714 439/108 |
| 7,029,334 | B2 * | 4/2006 | Shibuya | H01R 12/7076 439/660 |
| 7,618,296 | B2 * | 11/2009 | Caveney | H01R 13/6658 439/676 |
| 7,806,738 | B2 * | 10/2010 | Wu | H01R 13/055 439/860 |
| 7,927,152 | B2 * | 4/2011 | Pepe | H01R 24/64 439/676 |
| 8,632,367 | B2 * | 1/2014 | Caveney | H01R 13/6466 439/676 |
| 8,727,809 | B2 * | 5/2014 | Mongold | H01R 12/721 439/607.14 |
| 8,814,588 | B2 * | 8/2014 | Wang | H01R 12/774 439/358 |
| 8,827,750 | B2 * | 9/2014 | Chung | H01R 13/6461 439/660 |
| 8,968,010 | B2 * | 3/2015 | Endo | H01R 4/48 439/82 |
| 9,130,313 | B2 * | 9/2015 | Mongold | H01R 12/721 |
| 9,252,541 | B2 * | 2/2016 | Kumamoto | H01R 13/6581 |
| 9,853,403 | B1 * | 12/2017 | Chen | H01R 24/60 |

* cited by examiner (A)

(B)

(C)

ELECTRICAL CONNECTOR

CROSS REFERENCE TO RELATED APPLICATIONS

This Paris Convention patent application claims benefit under 35 U.S.C. § 119 and claims priority to Japanese Patent Application No. JP 2016-139324, filed on Jul. 14, 2016, titled "ELECTRICAL CONNECTOR", the content of which is incorporated herein in its entirety by reference for all purposes.

BACKGROUND

Technical Field

The present invention relates to an electrical connector that has multiple contact portions provided on a single terminal.

Background Art

In order to improve the reliability of contact with counterpart terminals provided in a counterpart connector, terminals provided in an electrical connector are sometimes formed such that a single terminal has multiple contact portions. An electrical connector provided with terminals having such multiple contact portions is disclosed, for example, in Patent Document 1. In Patent Document 1, respective multipoint contacts (terminals) come into contact with pin contacts (counterpart terminals) provided in a counterpart connector at a certain contact pressure using hereinafter described four contact point portions (contact portions). The above-mentioned multipoint contacts, which are made by bending a sheet metal member, are shaped to be of a substantially U-shaped configuration when viewed in the direction of connection of the two connectors and are provided with two mutually opposed leg portions and a coupling portion that couples said leg portions. They have a retaining portion retained by the housing and first to third spring strips extending in the above-mentioned direction of connection from the two mutually opposed leg portions of said retaining portion. A first and second contact point portions, which clamp a counterpart terminal, are provided at the distal ends of a first and second spring strips. The distal end of the third spring strip, which is positioned between the first and second spring strips, is provided more distally than the above-mentioned first and second contact point portions and has a third and fourth contact point portions that clamp the above-mentioned counterpart terminal. In this way, on the whole, the multipoint contacts have the above-mentioned substantially U-shaped configuration.

However, the multipoint contacts of the connector of Patent Document 1 must have spacing provided therein to permit insertion of the abovementioned pin contacts respectively between the first and second contact point portions and between the third and fourth contact point portions. Thus, when there is spacing between the first and second contact point portions and between the third and fourth contact point portions, signals are transmitted along two mutually spaced paths. As a result, for example, when the connector is used for high-speed transmission signals, the impedance characteristics of the above-mentioned multipoint contacts deteriorate. In addition, since the dimensions of the multipoint contacts in the terminal array direction are increased depending on how much the contact point portions are spaced apart, in other words, depending on how much the spring strips are spaced apart, the size of the electrical connector in the terminal array direction increases when arranging a large number of said multipoint contacts.

Accordingly, Patent Document 2 provides an electrical connector in which the terminals are fabricated as a single member by bending a sheet metal member. It has two arm portions that have parallel and separated major surfaces opposed in the terminal array direction and that extend in the direction of connection to counterpart connector bodies. The base portions of said two arm portions are coupled in a state of close proximity to each other in the through-thickness direction as a result of the above-described bending. The above-mentioned two arm portions are independently resiliently displaceable within the plane comprising the above-mentioned major surfaces, and contact portions intended for contacting the corresponding contact portions provided in the above-mentioned counterpart connector bodies are respectively formed at the distal end sides in the above-mentioned direction of connection. The contact portions of these two arm portions are disposed in close proximity while being in contact, at a certain contact pressure, with a major surface of one of the above-mentioned corresponding contact portions using a through-thickness face of said contact portions.

PRIOR ART DOCUMENT

Patent Documents

[Patent Document 1] Japanese Examined Utility Model Application No. H05-009822
[Patent Document 2] Japanese Patent Application No. 2014-127422

SUMMARY

Problems to be Solved by the Invention

In the terminals described in Patent Document 2, sheet metal members are bent to form two arm portions, as a result of which the contact portions of both arms are placed in close proximity to each other, thereby solving the problem of Patent Document 1, which was a reduction in impedance characteristics. However, while the two contact portions are in close proximity, their positions are different in the terminal array direction. Therefore, if foreign matter adheres to the counterpart connector bodies, the foreign matter may sometimes get stuck between the both of the above-mentioned two contact portions and the counterpart connector bodies when the above-mentioned two contact portions enter into a connected state while sliding relative to said counterpart connector bodies. As a result, faulty contact may occur at both contact portions.

The present invention was made by considering the above-mentioned circumstances and it is an object of the invention to provide an electrical connector in which a reduction in impedance characteristics is prevented with the help of terminals having contact portions on each of their two arm portions and, in addition, the contact portions can ensure an adequate connected state between them and counterpart connector bodies even if foreign matter adheres to the counterpart connector bodies.

Means for Solving the Problems

It is an object of the invention to provide an electrical connector in which a reduction in impedance characteristics is prevented with the help of terminals having contact portions on each of their two arm portions and, in addition, the contact portions can ensure an adequate connected state between them and counterpart connector bodies even if foreign matter adheres to the counterpart connector bodies.

The inventive electrical connector has multiple terminals retained in place in array form in a housing such that a direction perpendicular to the direction of connection to counterpart connector bodies is a terminal array direction.

In such an electrical connector, in the present invention, the above-mentioned terminals are made of sheet metal and have at least two arm portions that have their major surfaces opposed to each other and are separated from each other in the terminal array direction and extend in the above-mentioned direction of connection; the above-mentioned two arm portions are coupled to each other at their base portions and can come into contact with counterpart connector bodies by independently undergoing resilient displacement; the contact portions of the above-mentioned two arm portions intended for contacting the corresponding contact portions provided in the above-mentioned counterpart connector bodies are respectively formed at the distal end sides, i.e. at the sides opposite the above-mentioned base portions, in the above-mentioned direction of connection; and the contact portions of the two arm portions, along with being located in different positions in the direction of connection, are located in overlapping positions in the above-mentioned terminal array direction when connected to the counterpart connector bodies.

Thus, in the present invention, contact portions provided on each of the two arm portions constituting a single terminal are positioned one behind the other in a straight line extending in the direction of connection to counterpart connector bodies. Consequently, should foreign matter adhere at the site of connection to the counterpart connector bodies, the initial contact portion among the two contact portions will scrape off the foreign matter, such that the above-mentioned foreign matter will never reach the subsequent contact portion and the subsequent contact portion will provide adequate reliable contact.

In the present invention, at least one of the contact portions of the two arm portions has a curved shape that is offset in the terminal array direction relative to a base-side section of an arm, as a result of which the two contact portions can be positioned one behind the other in a single line.

Effects of the Invention

In the present invention, as described above, the contact portions of the two arm portions provided on a single terminal, along with being located in different positions in the direction of connection, are located in a straight line extending in the direction of connection in the same position in the terminal array direction when connected to the counterpart connector bodies, and, therefore, the above-mentioned contact portions of the two arm portions are positioned one behind the other in a single straight line in the above-mentioned direction of connection, so that even if foreign matter adheres at the site of contact to the counterpart connector bodies, the initial contact portion will scrape off the foreign matter and, as a result, the above-mentioned foreign matter will not reach the subsequent contact portion and at least the subsequent contact portion will provide adequate reliable contact with the counterpart connector bodies.

BRIEF DESCRIPTION OF DRAWINGS

FIG. 3(A) shows a state prior to connector mating, and FIG. 3(B) shows a state after connector mating.

FIGS. 4(A) to 4(C) illustrates a terminal of the receptacle connector of FIGS. 3(A) and 3(B), wherein FIG. 4(A) is a front view, FIG. 4(B) is a side view, and FIG. 4(C) is a rear view.

FIG. 5(A) is an oblique view of a first variation, FIG. 5(B) is that of a second variation, and FIG. 5(C) is that of a third variation.

DETAILED DESCRIPTION

An embodiment of the present invention will be described hereinbelow by referring to the accompanying drawings.

Figure 1:
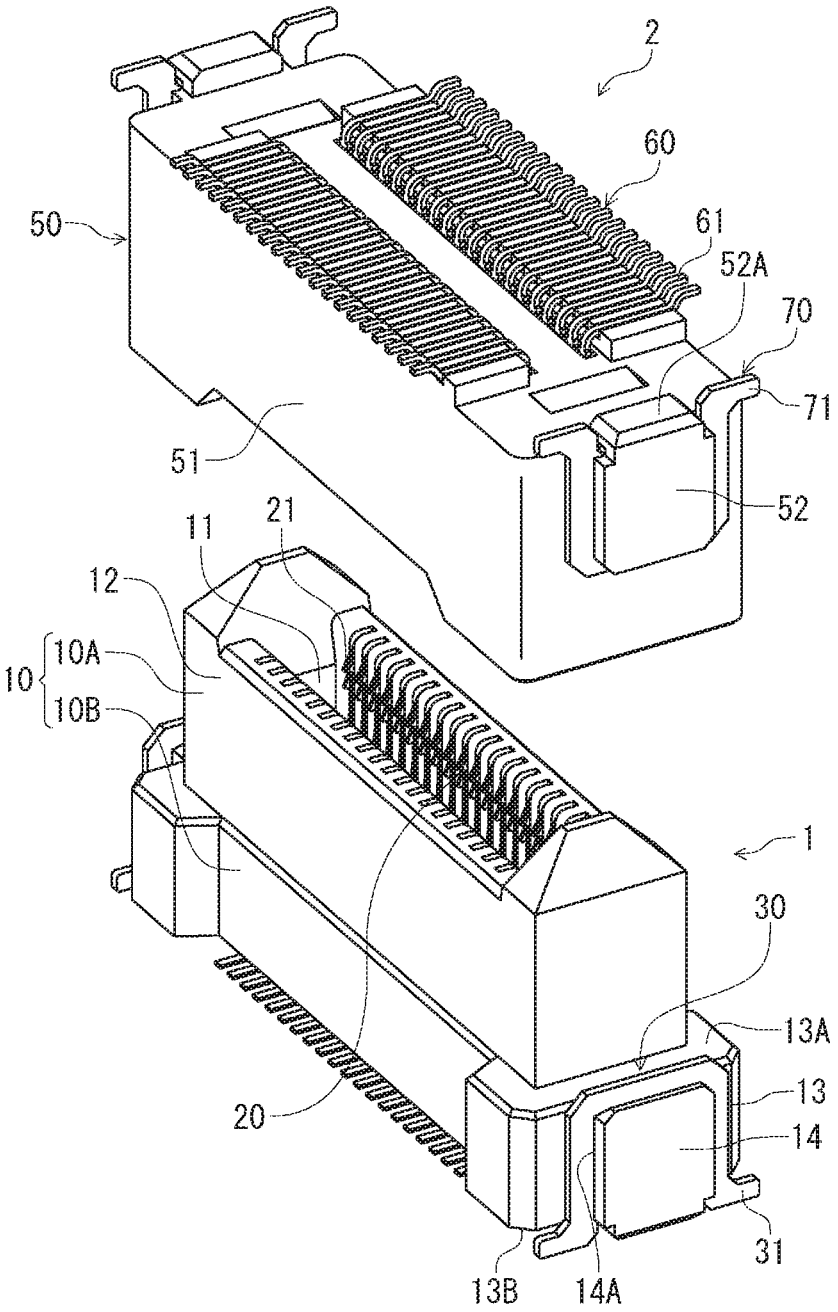
FIG. 1 illustrates an oblique view illustrating the appearance of a receptacle connector used in an embodiment of the present invention and its counterpart plug connector in a state prior to connector mating.

FIG. 1 is an oblique view illustrating the appearance of the receptacle connector 1 of the present embodiment and the counterpart plug connector 2 mated therewith in a state prior to the mating.

The receptacle connector 1 has a receptacle housing 10 made of an electrically insulating material and multiple terminals 20 made of sheet metal retained in place in array form in said receptacle housing 10. The receptacle housing 10 has a substantially rectangular parallelepiped-like external configuration in which its dimensions in the connector width direction, which is the array direction of the terminals 20, are larger than its dimensions in the connector thickness direction, which is perpendicular thereto and which extends to a high level in the vertical direction, which is the direction of connection, i.e. the direction of mating with the plug connector 2. Said receptacle housing 10 has formed therein an upwardly open accepting concave portion 11 intended for accepting a mating convex portion provided in the hereinafter described mating concave portion of the counterpart plug connector 2. The outer peripheral surface of its upper half portion 10A is an outer mating surface 12 that fits into the mating concave portion of the above-mentioned plug connector 2. In the above-mentioned receptacle housing 10, its lower half portion 10B, which is located at a lower level relative to the upper half portion 10A having the outer mating surface 12 formed on its outer peripheral surface, has a stepped configuration relative to said outer mating surface 12 and protrudes both in the connector width direction, in which the terminal array is formed, and in the thickness direction. In particular, in both end portions in the connector width direction, it protrudes more than in the other sections and has positioning portions 13 formed therein. Opposed surfaces 13A facing the plug connector, which constitute the upper faces of said positioning portions 13, abut opposed surfaces constituting the corresponding lower end faces of the counterpart plug connector 2, thereby determining the mating depth position of the plug connector 2. In addition, the bottom faces 13B of said positioning portions 13 determine the position of said receptacle connector 1 on the circuit board (not shown). Furthermore, fitting-retaining protrusions 14 are provided to protrude from the end faces of the above-mentioned positioning portions 13 in the terminal array direction. Gate-shaped groove portions 14A are formed on their upper faces and side faces, with gate-shaped anchor fittings 30 press-fitted into said groove portions 14A. Said anchor fittings 30 have securing portions 31 extending laterally in the connector thickness direction at their lower ends, and said securing portions 31 are solder-attached to the corresponding portions of the circuit board.

The terminals 20 of this receptacle connector 1 have contact portions 21 located on the inner surface of the accepting concave portion 11 of the above-mentioned receptacle housing 10 and connecting portions 22 extending from the bottom face of the receptacle housing 10. The above-mentioned contact portions 21 are in contact with the terminals of the plug connector 2, and the connecting portions 22 are solder-connected to the corresponding circuitry on the circuit board. These terminals 20, in conjunction with the receptacle housing 10, will be discussed in detail below with reference to FIG. 2 et seq.

As can be seen in FIG. 1, the counterpart plug connector 2 of the above-mentioned receptacle connector 1 has a mating concave portion (not shown in FIG. 1) that mates with the outer mating surface 12 formed in the upper half portion 10A of the receptacle connector 1 and is formed inside the perimeter wall 51 of the plug housing 50 made of electrically insulating material. In addition, terminals 60, which serve as counterpart connector bodies for the terminals 20 of said receptacle connector 1, are retained in place by the plug housing 50. Said plug housing 50 has provided therein fitting-retaining protrusions 52 similar to the fitting-retaining protrusions 14 provided in the receptacle housing 10 of the receptacle connector 1 at both ends in the connector width direction, and anchor fittings 70 similar to the anchor fittings 30 of the receptacle connector 1 are attached thereto. In the same manner as the anchor fittings 30 of the receptacle connector 1, said anchor fittings 70 are gate-shaped, have securing portions 71 protruding in the connector thickness direction, and are solder-attached to the circuit board via said securing portions 71. The above-mentioned positioning portions 13 determine the position of the bottom faces 52A, which face upwardly in FIG. 1, on the circuit board.

The terminals 60 of the plug connector 2 have contact portions (not shown in FIG. 1), which are in contact with the contact portions 21 of the terminals 20 of the receptacle connector 1, and connecting portions 61, which are solder-connected to the corresponding circuitry on the circuit board. The terminal 60, in conjunction with the retaining plug housing 50, will be described below with reference to FIG. 2 et seq. in association with the above-mentioned terminals 20 of the receptacle connector 1.

The terminals 20 of the receptacle connector 1 and the terminals 60 of the plug connector 2 will now be described in conjunction with the receptacle housing 10 and plug housing 50 that respectively retain them.

Figure 2:
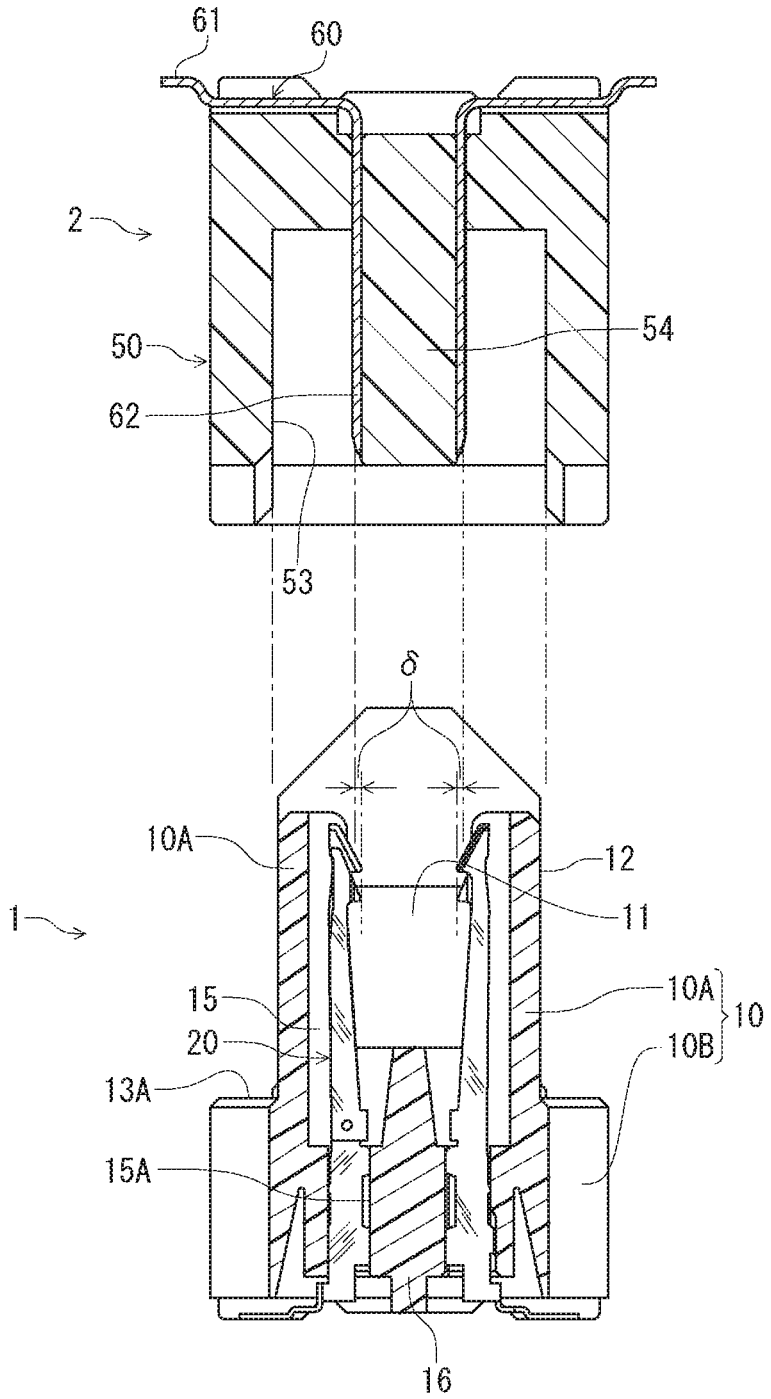
FIG. 2 illustrates a vertical cross-sectional view of a terminal illustrating the receptacle connector and plug connector of FIG. 1 in a state prior to connector mating.

As can be seen in FIG. 1, multiple pairs of terminals 20 of the receptacle connector 1 are arranged facing each other in the connector thickness direction such that the connector width direction is the array direction. FIG. 2 illustrates a pair of terminals 20 facing each other in the connector thickness direction (horizontal direction in FIG. 2). Both terminals 20 are of identical shape and are disposed facing each other so to be mirror images of each other in FIG. 2. Accordingly, only one of the terminals will be discussed here.

Figure 3A:
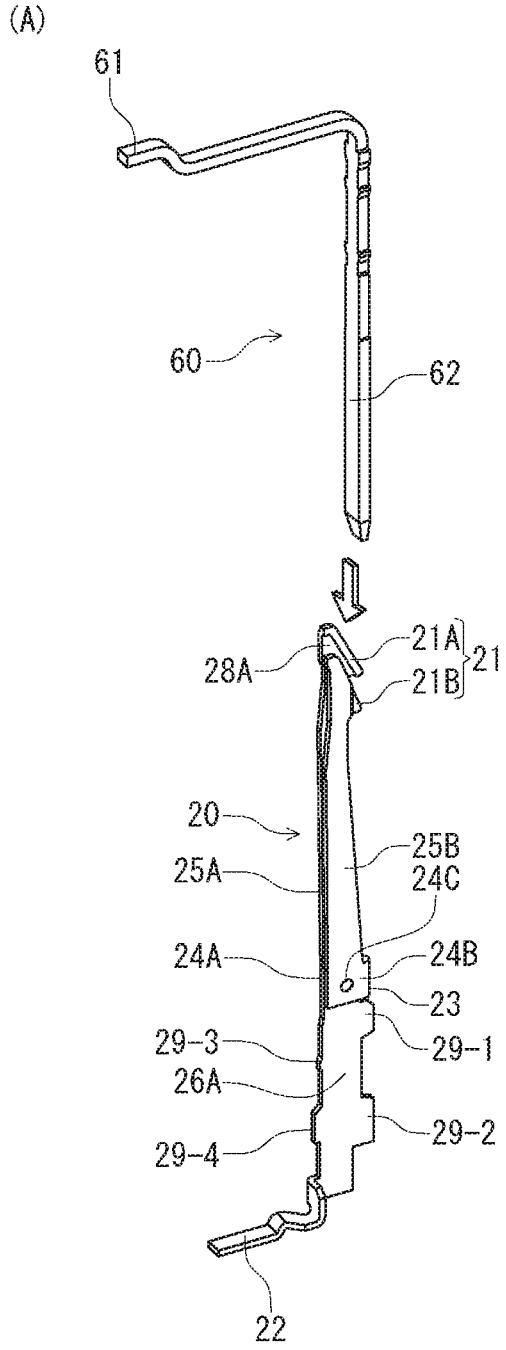
FIGS. 3(A) and 3(B) illustrate an oblique view illustrating terminals taken from the receptacle connector and from the plug connector of FIG. 1, where

The above-mentioned terminal 20 of the receptacle connector 1 is made of sheet metal and, as shown in FIG. 3(A), is shaped as curved strip-like piece. The terminal 20 is bent to permit overlapping at a bent portion 23 and has arm portions 25A, 25B, which upwardly extend from the respective two base portions 24A, 24B coupled at said bent portion 23, and a laterally extending connecting portion 22, which is bent in an L-shaped configuration from the lower end of an extension portion 26A extending downwardly from the base portion 24A of one of the arm portions 25A.

As can be seen in FIG. 3(A) and FIGS. 4(A) to 4(C), in the terminal 20, one of the arm portions 25A, with the exception of its upper distal edge, is formed in a strip-like shape having the same flat major surface be the base portion 24A as well as the extension portion 26A. When the above-mentioned arm portion 25A is viewed in the through-thickness direction (direction perpendicular to the above-mentioned major surface), the width of said arm portion 25A narrows from the base portion 24A towards the upper distal end and, in the upper distal end portion, there is formed a contact protrusion 28A that is triangular in shape and protrudes unilaterally in the width direction. Said contact protrusion 28A has formed therein a contact portion 21A, whose upper distal edge is bent by press-forming in the through-thickness direction in a crank-like configuration, thereby positioning it at a location halfway in the through-thickness direction towards the other arm portion 25B, and said contact portion 21A contacts the terminals 60 of the plug connector 2, i.e. the counterpart connector bodies, with its triangular top portion shaped as a protrusion in the above-mentioned width direction. The above-mentioned contact portion 21A is offset to the above-mentioned location halfway in the through-thickness direction relative to the base portion 24A.

For reinforcement purposes, the above-mentioned arm portion 25A has its base portion 24A bonded to the base portion 24B of the other arm portion 25B using spot welding or caulking 24C. Protruding fixation projections 29-1, 29-2; 29-3, 29-4 are provided at two locations in the vertical direction on each of the two lateral edges of the extension portion 26A that extends downwardly from the base portion 24A of the above-mentioned arm portion 25A. When the above-mentioned extension portion 26A is press-fitted into the hereinafter described corresponding terminal retaining hole in the receptacle housing 10, said fixation projections 29-1, 29-2; 29-3, 29-4 engage with said terminal retaining hole, thereby fixing its position and acting to prevent extraction.

The connecting portion 22, which is first bent to have a perpendicular surface relative to the surface of said extension portion 26A at the lower end of the above-mentioned extension portion 26A and then bent in a substantially L-shaped configuration to extend in a lateral direction, is bent so as to bring the position of said connecting portion 22 in the width direction back in the direction of the above-mentioned extension portion 26A and, subsequently, bent at the center in a crank-like configuration in the through-thickness direction, with the distal end side thereof solder-connected to the circuit board.

Figure 4A:
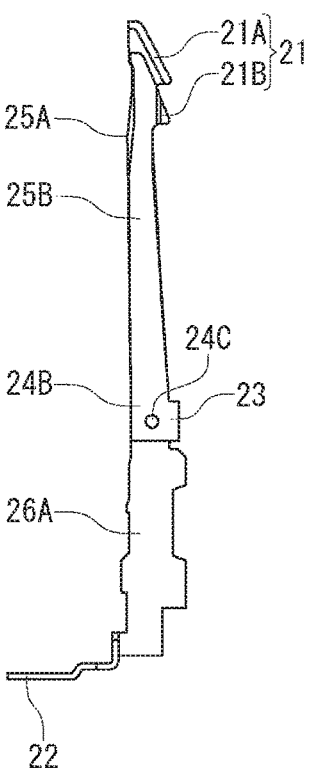
Figure 4B:
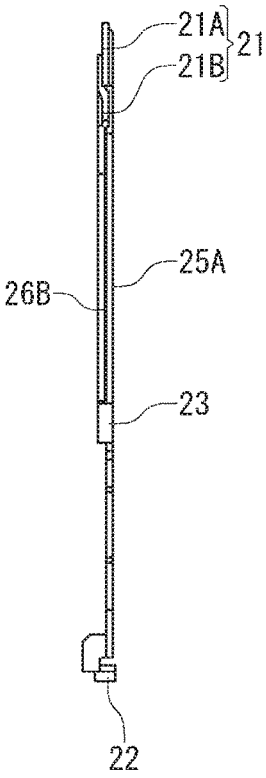
Figure 4C:
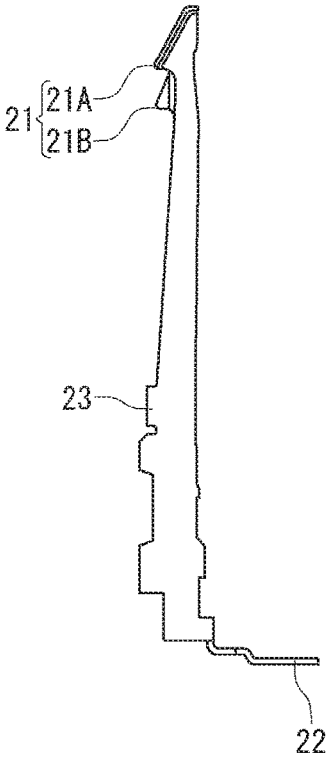

So far as concerns the other arm portion 25B that extends upwardly from the base portion 24B coupled to the base portion 24A of the above-mentioned arm portion 25A at the above-mentioned bent portion 23, as shown in FIG. 4 (A) and FIG. 4(C), when said arm portion 25B is viewed in the through-thickness direction, its shape and width dimensions are substantially identical to those of the above-mentioned arm portion 25A, but the contact protrusion 28B in the upper distal end portion is positioned slightly below the contact protrusion 28A of the arm portion 25A. In other words, the distance from the base portion 24B of the other arm portion 25B to the contact protrusion 28B is slightly shorter than the distance from the base portion 24A of the arm portion 25A to the contact protrusion 28A. When viewed from a direction perpendicular to the major surface, the contact protrusion 28B of the other arm portion 25B is of a triangular shape substantially identical to that of the contact protrusion 28A of the arm portion 25A and is positioned slightly below said contact protrusion 28A. While its top portion is also of the same height as the above-mentioned contact protrusion 28A, the distal edge of the contact protrusion 28B is not bent like the contact portion 21A, and the top portion of said contact protrusion 28B is bent in a crank-like configuration so as to be offset towards the arm portion 25A in the through-thickness direction of said contact protrusion 28B, with its top portion constituting a contact portion 21B and being in contact with a terminal 60 of the plug connector 2, i.e. a counterpart connector body.

In this way, as can be seen in FIG. 2, the contact portion 21A of the arm portion 25A and the other contact portion 21B have slightly different height positions in the direction of connection (vertical direction in FIG. 2) of the two connectors. However, their positions are identical in the connector thickness direction (horizontal direction in FIG. 2), and, in addition, their positions are also identical in the connector width direction, which is the terminal array direction (direction perpendicular to the viewing plane in FIG. 2). Therefore, the two contact portions 21A, 21B are positioned in straight line in the above-mentioned direction of connection and are longitudinally (vertically in the figure) shifted with respect to each other in the direction of connection.

As described above, the base portions 24A and 24B of the arm portions 25A, 25B, which respectively have contact portions 21A, 21B positioned one behind the other in a straight line in the direction of connection, are coupled to each other at the bent portion 23. For this reason, while the major surfaces approach each other, a small gap is still formed therebetween, which makes it possible to undergo displacement due to resilient flexure independently of each other in the terminal width direction, i.e. in the connector thickness direction (horizontal direction in FIG. 2), with the base portions 24A, 24B as a base point.

As can be seen in FIG. 1 and FIG. 2, these terminals 20 of the receptacle connector 1, along with constituting left-right symmetrical pairs of terminals, form an array of multiple pairs secured in place by the receptacle housing 10. While the external configuration of said receptacle housing 10 is as described previously with reference to FIG. 1, on the inside, there is an accepting concave portion 11 formed in the upper portion thereof, and terminal grooves 15, which extend downwardly from the inner surface of said accepting concave portion 11 and pass therethrough to open on the bottom face of the receptacle housing 10, are formed in the locations where the terminals 20 are arranged. The above-mentioned terminal groove 15 is a slit aperture in the relatively thick bottom wall 16 of the receptacle housing 10 that has a terminal retention hole 15A formed therein. The above-mentioned terminal 20 is upwardly press-fitted into this terminal retaining hole 15A from below, and the fixation projections 29-1, 29-2; 29-3, 29-4 provided at the two lateral edges of the extension portion 26A of the terminal 20 engage with the inner surface of the above-mentioned terminal retaining hole 15A, thereby determining the position of the terminal 20 and, at the same time, preventing it from being extracted. The two arm portions 25A, 25B of the terminal 20 are contained inside the terminal groove 15 formed on the inner surface of the accepting concave portion 11 of the above-mentioned receptacle housing 10, with only the contact portions 21A, 21B protruding from said terminal groove 15. The connecting portions 22 of the terminals 20 protrude outside the receptacle housing 10 on the bottom face side of said receptacle housing 10, and when the receptacle connector 1 is placed on the circuit board, they are positioned in locations where they come into contact with the corresponding circuitry of said circuit board.

As can be seen in FIG. 2, in the plug connector 2 mated with the receptacle connector 1, the plug housing 50 has formed therein a mating concave portion 53, with which the upper half portion 10A of the receptacle housing 10 of the receptacle connector 1 mates through the medium of the outer mating surface 12, and said housing 50 retains the terminals 60 in place. The dimensions of the inner surface of the above-mentioned mating concave portion 53 are designed to fit the outer mating surface 12 of the upper half portion 10A of the above-mentioned receptacle connector 10 and, in the central portion of said mating concave portion 53, there is formed a mating convex portion 54 that enters the accepting concave portion 11 of the above-mentioned receptacle connector 1.

In FIG. 2, the contact portions 62 of the terminals 60, which are positioned in a left-right symmetrical configuration on both sides of the above-mentioned mating convex portion 54, are arranged in a direction perpendicular to the viewing plane. Said terminals 60 are obtained when strip-shaped metal pieces, whose width is the direction perpendicular to the viewing plane, i.e. the terminal array direction, are bent in their through-thickness direction, thereby producing a generally inverted L-shaped configuration. In the state illustrated in FIG. 2, said terminals 60 protrude from the bottom face (upper face in FIG. 2) of the plug housing 50 outside the plug housing 50 while being bent in an inverted L-shaped configuration and extending laterally. The distal end sides (free end sides) of these lateral sections form crank-shaped stepped portions, and their distal end portions form connecting portions 61. Said connecting portions 61 are solder-connected to the corresponding circuitry of the circuit board (not shown).

In this way, the terminals 60 of the plug connector 2 have their major surfaces at right angles with respect to the above-mentioned terminals 20 of the receptacle connector 1. Therefore, since the distal edges formed on the terminals 10 of the receptacle connector 1 are bent and the strip-shaped contact portions 62 of the terminals 60 of the plug connector 2 come into contact with the contact portions 21A, which have a narrow contact width, and the contact portions 21B, which also have a narrow contact width, i.e. the through-thickness width, through the medium of the major surfaces, which expand in their width direction, the range of possible contact is widened and the contact portions 21A, 21B of the terminals 10 of the receptacle connector 1 are reliably held within the extent of the above-mentioned contact portions 62.

In addition, the terminals 60 of the above-mentioned plug connector 2 have their contact portions 62 retained in place by the wall surfaces of the mating convex portion 54 of the plug housing 50, thereby maintaining a constant distance between the surfaces of two opposed contact portions 62. As can be seen in FIG. 2, this distance is greater than the distance between two contact portions 21A and the distance between two contact portions 21B in the free state of opposed terminals 20 of the receptacle connector 1 by a small amount 6, and when the connectors are mated, the above-mentioned contact portions 62 cause the contact portions 21A, 21B to undergo resilient displacement equal to the above-mentioned amount 6.

Figure 3B:
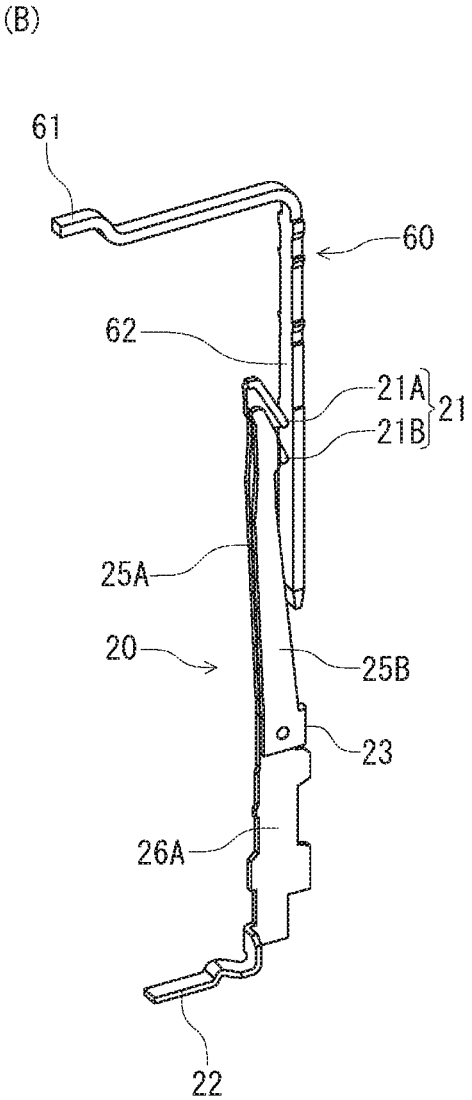

The way the above-described receptacle connector 1 and counterpart plug connector 2 are used will now be explained with reference to FIG. 2 and FIG. 3.

FIG. 2, which has been referenced in the previous discussion, is a vertical cross-sectional view of a terminal shown prior to the mating of the receptacle connector 1 and plug connector 2. FIG. 3 shows terminals 20, 60 taken from the two connectors 1, 2, wherein (A) is a state prior to connector mating and (B) is a state after connecting the connectors.

First of all, the receptacle connector 1 is placed on the corresponding circuit board and the connecting portions 22 of the terminals 20 are solder-connected to the corresponding circuitry on the above-mentioned circuit board. Additionally, the securing portions 31 of the anchor fittings 30 are solder-attached to the corresponding portions. Meanwhile, the plug connector 2 is placed on the other corresponding circuit board and the connecting portions 61 of the terminals 60 are solder-connected to the corresponding circuitry on the above-mentioned other circuit board. Additionally, the securing portions 71 of the anchor fittings 70 are solder-attached to the corresponding portions.

Next, as shown in FIG. 2 and FIG. 3(A), in which the above-mentioned circuit board and the other circuit board are not illustrated, the plug connector 2 is placed above the receptacle connector 1 and the position and orientation of the two connectors 1, 2 are adjusted in preparation for mating. In the state depicted in FIG. 2, the circuit board, to which the receptacle connector 1 is attached, is positioned on the bottom face of said receptacle connector 1, and the other circuit board, to which the plug connector 2 is attached, is positioned on the upper face of said plug connector 2, with the above-mentioned circuit board and the other circuit board maintaining a parallel orientation.

After this, the lowering of the above-mentioned plug connector 2 attached to the other circuit board initiates the fitting of the upper half portion 10A of the receptacle connector 1 into the mating concave portion 53 of said plug connector 2 as well as the fitting of the mating convex portion 54 of the plug connector 2 respectively into the accepting concave portion 11 of said receptacle connector 1.

Immediately upon initiation of the fitting of the mating convex portion 54 of the plug connector 2 into the accepting concave portion 11 of the receptacle connector 1, the contact portions 62 of the terminals 60 located on the wall surface of the mating convex portion 54 of the plug connector 2 come into contact with the contact portions 21A, 21B of the terminals 20 located inside the accepting concave portion 11 of the receptacle connector 1, that is, first with the contact portion 21A, and subsequently with the contact portion 21B. At such time, said contact portions 21A, 21B are pushed in a lateral direction by the above-mentioned contact portions 62 and, as a result of undergoing lateral resilient flexure, the arm portions 25A, 25B are resiliently displaced by the above-mentioned amount 6. In other words, the contact portions 21A, 21B come into contact with the above-mentioned contact portions 62 at a contact pressure corresponding to said amount 6 of resilient displacement (see also FIG. 3(B)). It should be noted that, in the present embodiment, when the above-mentioned arm portions 25A, 25B undergo resilient flexure, the extension portions 26A may also undergo resilient flexure, which makes it possible to readily ensure the above-mentioned amount 6 in the contact portions 21A, 21B.

As previously discussed, the above-mentioned contact portions 21A, 21B are positioned one behind the other (vertically in FIG. 2) in a straight line in the direction of connection of the connectors (vertical direction in FIG. 2). Therefore, if foreign matter adheres to the contact portions 62 of the terminals 60 of the plug connector 2 before connector mating, or if foreign matter gets between the above-mentioned contact portions 62 of the plug connector 2 and the above-mentioned contact portions 21A of the receptacle connector 1 during connector mating, the foreign matter is removed in a lateral direction under the action of the above-mentioned contact pressure between the above-mentioned contact portions 62 and the contact portions 21A of the receptacle connector 1, which are the first to come into contact with the contact portions 62 of the plug connector 2. Consequently, the foreign matter never reaches the contact portions 21B, which are located rearwardly of the above-mentioned contact portions 21A along the above-mentioned straight line in the direction of connection of the connectors and are the next to come into contact with the contact portions 62. Therefore, excellent contact with the contact portions 62 of the plug connector 2 is ensured at least by the rear contact portions 21B among the two contact portions 21A, 21B of the terminals 20 of the receptacle connector 1.

The inventive terminals 20 of the receptacle connector 1 are not limited to the states illustrated in FIGS. 1-4 and numerous variations thereof are possible. Possible variations are respectively illustrated in FIGS. 5(A) to 5(C). It should be noted that FIGS. 5(A) to 5(C) illustrate only the upper arm portions of the terminals 20 above the base portions, with the extension portions and connecting portions omitted.

Figures 5A, 5B, 5C:
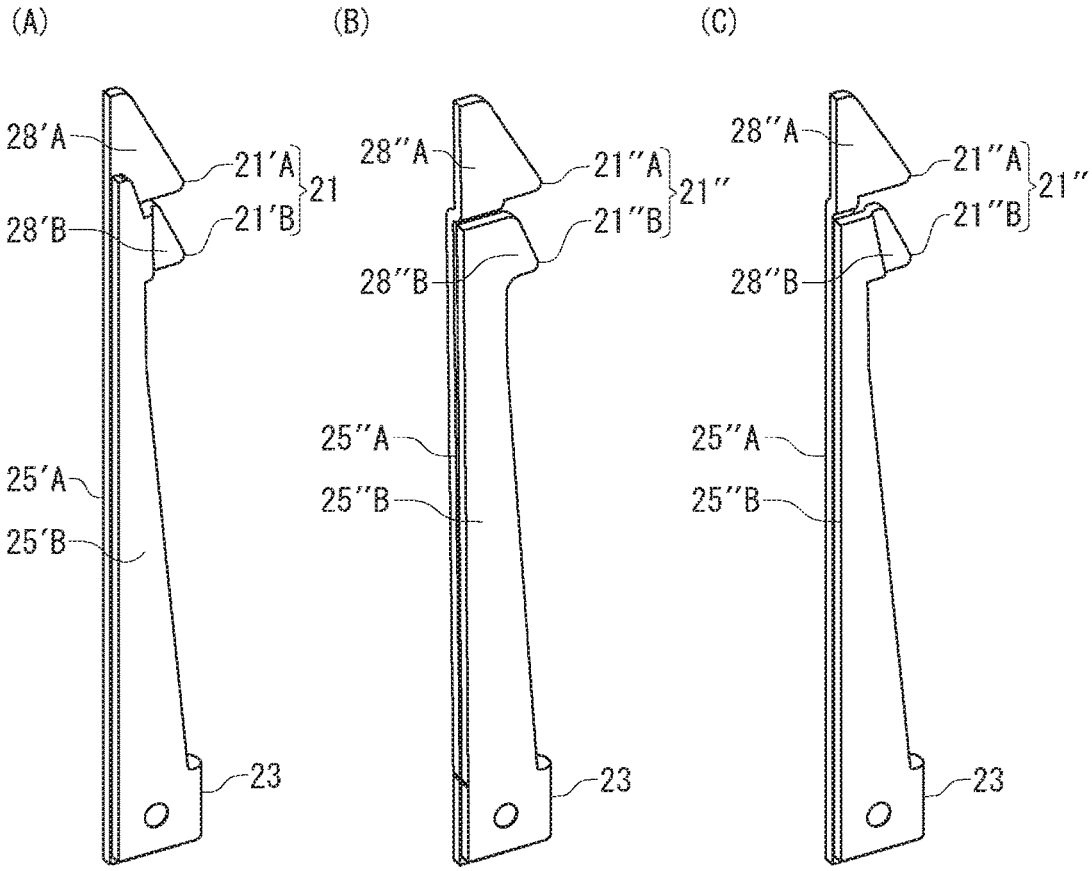
FIGS. 5(A) to 5(C) illustrate variations of the terminal of the receptacle connector of FIGS. 3(A) and 3(B) showing only the main portion of the terminal, where

A first variation is shown in FIG. 5(A). While in the terminal 20 of the preceding FIGS. 1-4, the distal edge of the triangular contact protrusion 28A provided in one arm portion 25A was bent in the through-thickness direction in a crank-like configuration to form a contact portion 21A, in the variation of FIG. 5(A), one arm portion 25'A is not curved in the through-thickness direction and remains a flat plate. Therefore, the contact portion 21'A is constituted by a through-thickness face of the top portion of the triangular contact protrusion 28'A. By contrast, at its base, the triangular contact protrusion 28'B of the other arm portion 25'B is bent in the through-thickness direction in a crank-like configuration and is offset in the through-thickness direction, which positions the contact portion 21'B in a straight line in the direction of connection of the connectors that passes through the contact portion 21'A. Therefore, the amount of offset of the contact protrusion 28'B of the other arm portion 25'B is larger than in the case of the contact protrusion 28B of the preceding FIGS. 1-4.

A second variation will be described next. While in FIGS. 1-4 the distal edge of the triangular contact protrusion 28A of one arm portion 25A was bent in the through-thickness direction in a crank-like configuration, in this second variation, as can be seen in FIG. 5(B), the contact protrusion 28"A is bent at its base in the through-thickness direction in a crank-like configuration such that the entire contact protrusion 28"A of the arm portion 25"A is offset in the through-thickness direction. In the other arm portion 25"B, the contact protrusion 28"B is not bent and remains flat.

Now, a third variation, which is depicted in FIG. 5(C), is an example that combines bending the arm portion 25"A of FIG. 5(B) with bending the other arm portion 25'B of FIG. 5(A). In the first variation, only the other arm portion 25'B, and in the second variation, only the arm portion 25'A was offset in the through-thickness direction. For this reason, the amounts of offset had to be equal to the plate thickness or made slightly larger than the plate thickness. In the third variation, however, both arm portions are offset towards each other. As a result, the amount of offset of a single arm portion is roughly half the offset used in the first and second variation, which facilitates manufacture. In the third variation, the arm portion 25"A of FIG. 5(B) and the other arm portion 25'B of FIG. 5(A) are combined, but the other arm portion 25'B has its distal end (upper end) cut off to prevent interference with the contact protrusion 28"A of the arm portion 25"A.

In this way, in the first through third variations, the contact portions are offset in the through-thickness direction relative to the other portions of the arm portion such that the contact portions of the two arm portions are positioned one behind the other in a straight line in the direction of connection of the connectors.

While the present invention has been described using a receptacle connector example as an embodiment, the connector can be either a receptacle connector or a plug connector. In addition, while a plug connector example has been used to illustrate counterpart connector bodies, it can be either a plug connector or a circuit board. In addition, although the contact portions of the two arms have been placed in the same positions in the terminal array direction, they may be positioned so as to overlap in the terminal array direction without being at the same positions.

Furthermore, although the terminals of the inventive connector have been described using an example with two arms, there may be three or more arms, in which case the contact portions of the arms will be in different positions in the direction of connection of the connectors while being in the same portions or overlapping positions in the terminal array direction.

DESCRIPTION OF THE REFERENCE NUMERALS

1 (Receptacle) connector
10 (Receptacle) housing
20 Terminals
21 (21A, 21B) Contact portions
21' (21'A, 21'B) Contact portions
21" (21"A, 21"B) Contact portions
24A, 24B Base portions
24'A, 24'B Base portions
24"A, 24"B Base portions
25A, 25B Arm portions
25'A, 25'B Arm portions
25"A, 25"B Arm portions

The invention claimed is:

1. An electrical connector comprising:

a plurality of terminals retained in place in array form in a housing such that a direction perpendicular to the direction of connection to counterpart connector bodies is a terminal array direction, wherein the terminals are made of sheet metal and comprise at least two arm portions with major surfaces opposed to each other and separated from each other in the terminal array direction and extend in the direction of connection;

wherein the two arm portions are coupled to each other at their base portions and come into contact with the counterpart connector bodies by independently undergoing resilient displacement;

wherein the contact portions of the two arm portions intended for contacting the corresponding contact portions provided in the counterpart connector bodies are respectively formed at distal end sides opposite the base portions, in the direction of connection;

wherein the contact portions of the two arm portions, are located in different positions in the direction of connection in overlapping positions in the terminal array direction when connected to the counterpart connector bodies;

and wherein the contact portions are positioned on a same side in a straight line in the direction of connection, and wherein each of the contact portions are configured to contact the corresponding contact portions provided in the counterpart connector bodies on the same side along the direction of connection during mating of the electrical connector.

2. The electrical connector according to claim 1, wherein at least one of the contact portions of the two arm portions has a curved shape that is offset in the terminal array direction relative to a base-side section of an arm.

* * * * *